US006409578B1

(12) United States Patent
Brian

(10) Patent No.: US 6,409,578 B1
(45) Date of Patent: Jun. 25, 2002

(54) ADJUSTABLE GRINDING METHOD AND APPARATUS

(76) Inventor: Frank J. Brian, 3701 Ahern St., Baldwin Park, CA (US) 91706

( * ) Notice: Subject to any disclaimer, the term of this patent is extended or adjusted under 35 U.S.C. 154(b) by 60 days.

(21) Appl. No.: 09/629,752

(22) Filed: Jul. 31, 2000

(51) Int. Cl.[7] ..... B24B 5/40

(52) U.S. Cl. ..... 451/51; 451/61; 451/150; 451/27

(58) Field of Search ..... 451/51, 61, 439, 451/430, 124, 150, 129, 140, 143, 27, 9, 11, 237, 246, 285

(56) References Cited

U.S. PATENT DOCUMENTS

| | | | |
|---|---|---|---|
| 810,903 | A | 1/1906 | Blechschmidt |
| 998,508 | A | 7/1911 | Hattersley et al. |
| 1,559,245 | A | 10/1925 | Gilbert |
| 1,580,379 | A | 4/1926 | Locken |
| 1,662,137 | A | 3/1928 | Summers |
| 1,729,288 | A | 9/1929 | Harrell |
| 1,756,014 | A | 4/1930 | Streby |
| 1,991,834 | A | 2/1935 | Albertson |
| 2,442,683 | A | 6/1948 | Green |
| 2,470,221 | A | 5/1949 | Mott |
| 2,720,736 | A | 10/1955 | McAfee |
| 2,738,627 | A | 3/1956 | Blagg |
| 3,022,608 | A | 2/1962 | Tree |
| 3,071,902 | A | 1/1963 | Curfman |
| 3,613,320 | A | 10/1971 | Mighton |
| 4,646,476 | A | 3/1987 | Yui |
| 5,321,918 | A | 6/1994 | Brian |

FOREIGN PATENT DOCUMENTS

| | | |
|---|---|---|
| EP | 204958 | 12/1986 |
| FR | 1246151 | 10/1960 |

*Primary Examiner*—Robert A. Rose
(74) *Attorney, Agent, or Firm*—William W. Haefliger

(57) ABSTRACT

A method of grinding the bore of a rotary spindle, the bore having a taper, to true the bore while the spindle rotates about a spindle axis, the steps that include providing a support attachable to a base associated with the spindle; providing an angled slide on the support, the slide being movable endwise relative to the spindle and at a predetermined angle to the spindle axis, that angle corresponding to the spindle bore taper; providing a rotary grinder on the angled slide to be movable endwise therewith while the grinder rotates, bodily adjusting the spindle to bring the spindle bore into position to be ground by a grinder as the grinder is moved on the angled slide relative to the bore, and as the spindle rotates; and operating the grinder to grind the tapered bore as the spindle is rotated and as the angled slide is moved endwise, at a predetermined angle.

12 Claims, 3 Drawing Sheets

ADJUSTABLE GRINDING METHOD AND APPARATUS

BACKGROUND OF THE INVENTION

This invention relates generally to truing the bores of rotary spindles, and more particularly concerns method and apparatus for effecting said truing by grinding the spindle bore while the spindle itself is rotating.

There are many advantages to grinding a spindle in place, one being the low down time. If the spindle were to be removed, more than likely the bearings and seals would, or at least should, be replaced. This becomes a procurement problem. Some seals and bearings can be long lead time procurement items. The spindle then needs to be sent out for grinding. This is also time consuming. All of this processing requires highly trained personnel, because in reassembly bearing preload and alignment is important.

There is another advantage to grinding in place, having to do with negating the run-out inherent in the bearings. By grinding in place, all items are taken into consideration and trued up.

U.S. Pat. No. 5,321,918 to Brian provides improved method and apparatus to enable grinding of a machine tool spindle in place, i.e., without removing it from the machine. That patent discloses a highly advantageous method of grinding the tapered bore of a rotary spindle, to true bore, and while the spindle rotates about a spindle axis, the steps of that method including:

a) providing structure including a master plate having a surface facing said bore, said surface having a predetermined boundary to define a center, b) providing an angled slide on said structure, the slide being movable endwise relative to said spindle and at a predetermined angle to said axis, said angle corresponding to the spindle bore taper, c) providing a rotary grinder on said angled slide to be movable endwise therewith while the grinder rotates, d) adjusting said structure to bring said master plate surface into perpendicularity to said axis and to bring said center into coincidence with said axis, and e) operating said grinder to grind said tapered bore as the spindle is rotated and as said angled slide is moved endwise at said predetermined angle to said structure.

There is need for further simplifying the above process, as for example to reduce weight and or bulk of the overall apparatus. This is particularly important in instances when the grinding apparatus must be transported to the site of a spindle or spindles to be ground, i.e. process simplification to enable apparatus portability is required.

SUMMARY OF THE INVENTION

Basically, the method of the invention concerns grinding the bore of a rotary spindle, said bore having a taper, to true said bore while the spindle rotates about a spindle axis, the steps that include:

a) providing a support attachable to a bore associated with said spindle, b) providing an angled slide on said support, the slide being movable endwise relative to said spindle and at a predetermined angle to said axis, said angle corresponding to the spindle bore taper, c) providing a rotary grinder on said angled slide to be movable endwise therewith while the grinder rotates, d) adjusting said spindle to bring said spindle bore into position to be ground by said grinder as the grinder is moved on said angled slide relative to the bore, and as the spindle rotates, e) operating said grinder to grind said tapered bore as the spindle is rotated and as said angled slide is moved endwise at said predetermined angle.

The above basic method takes advantage of accurate adjustability of the spindle so as to eliminate need for an additional slide carrying the angled slide and the rotary grinder, as disclosed in U.S. Pat. No. 5,321,918 referred to above.

Additional steps of the method may include adjusting the spindle in two directions, the first direction moving the spindle toward a guide surface extending in a second direction; and the spindle then being adjusted in that second direction to bring the spindle bore into position to be ground, as referred to. The axis of the spindle then coincides with the axis of a cone defined by the angled slide.

Further steps include providing a portable package which includes said support, the slide, the rotary grinder and the guide surface, and transporting the package to the location of the spindle and bore, for performing the steps a)–e) above.

In this regard the method may also include the step of removably attaching the support to the base, at the spindle site. Since need for a second slide for the support is eliminated, overall weight of the portable package is substantially reduced.

The basic apparatus for performing the method includes:

a) a support attachable to a bore associated with the spindle, b) an angled slide on the support, the slide being movable endwise relative to said spindle and at a predetermined angle to said axis, said angle corresponding to the spindle bore taper, c) a rotary grinder on said angled slide to be movable endwise therewith while the grinder rotates, d) the spindle adjustable in two dimensions into a position enabling grinding of the spindle tapered bore by the grinder as the grinder is moved on said angles slide relative to said bore, and as the spindle rotates, e) said grinder then operable to grind said tapered bore as the spindle is rotated and as said angled slide is moved endwise at said predetermined angle.

As will be seen, a guide surface is preferably attached to or integrated with the support, one of the two adjustment dimensions being a direction extending toward the guide surface (for example an X-direction), and the other of the two adjustment dimensions being a direction extending lengthwise of the guide surface (for example a Y-direction).

These and other objects and advantages of the invention, as well as the details of an illustrative embodiment, will be more fully understood from the following specification and drawings, in which:

DRAWING DESCRIPTION

FIG. 4 is a schematic plan view diagram.

DETAILED DESCRIPTION

Figure 1:
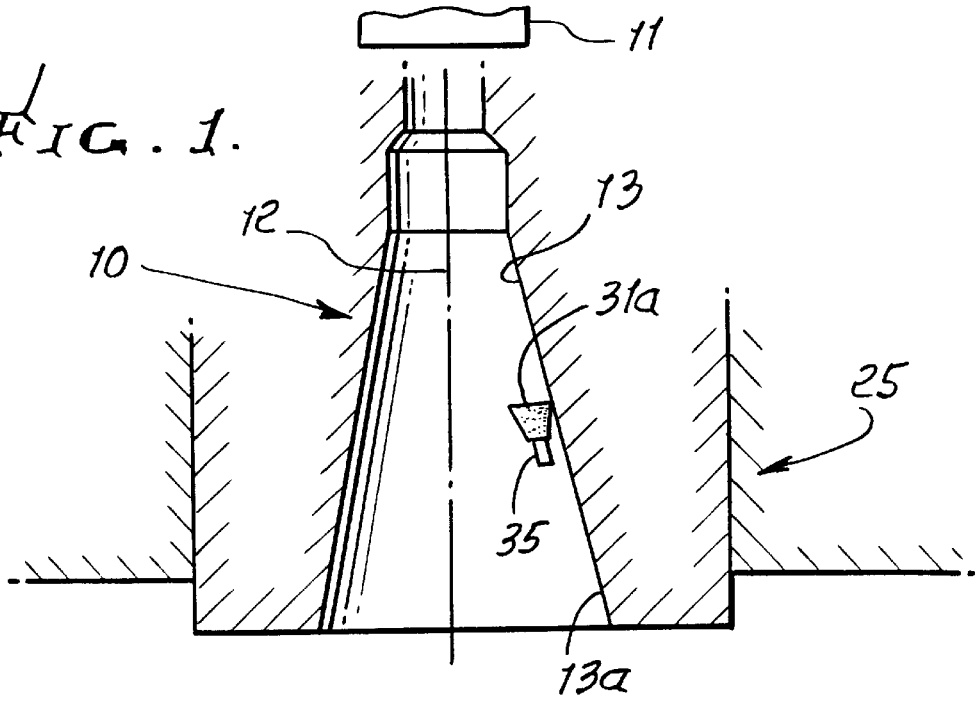
FIG. 1 is a section taken through a spindle, the bore of which is to be ground in place.

In the drawings, a rotary spindle 10 is rotatable by means generally indicated at 11, to rotate about an axis 12. The spindle is typically used during machining, such as milling, and may receive the shaft of a milling tool, the rotary tool engaging the spindle tapered bore 13. The latter typically becomes larger at its larger end 13*a* in use, due to wear. Also, chips and other foreign material may become trapped at the taper and cause deformation and taper deterioration. This can lead to decreased tool life, excess vibration, our of tolerance condition of the work to be machined, and poor finish of the latter.

Figure 2:
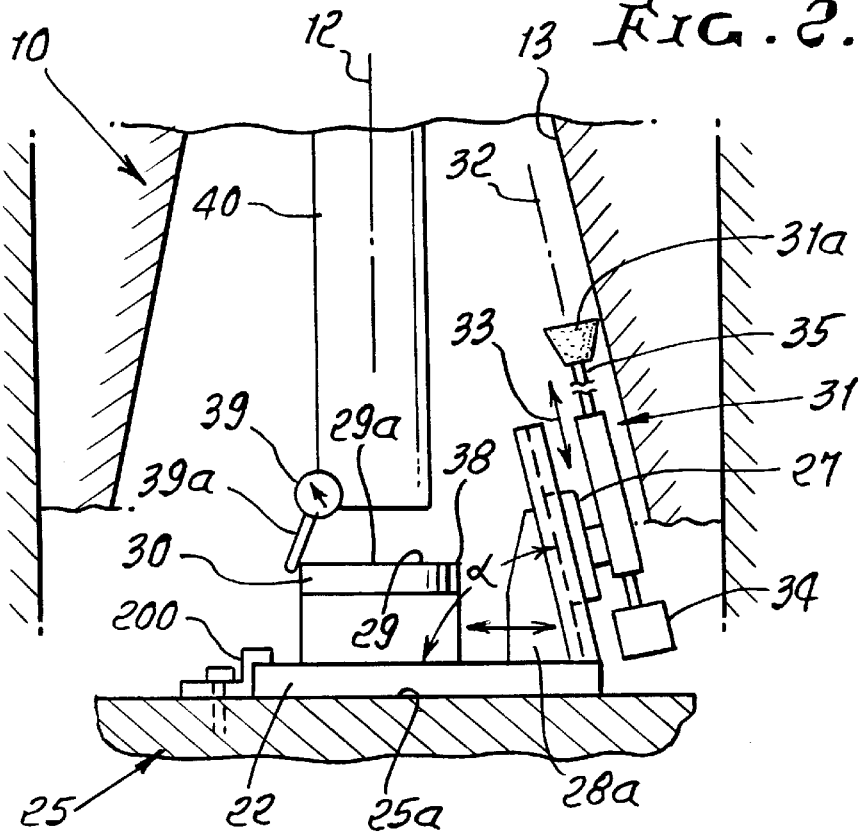
FIG. 2 is a schematic view of apparatus and method for accomplishing grinding of a spindle bore.

Referring to FIG. 2, method and means is provided to perform grinding of the spindle bore, without removing the spindle from the machine tool apparatus, i.e., in-place grinding to "true-up" the bore relative to axis 12. In this regard, the method, as claimed herein, may be carried out using apparatus to be described, or other equivalent apparatus. Such apparatus includes structure, including a support 22 having a surface facing the aligned bore 13, that surface having a predetermined boundary to define a center.

The support 22 is attached to machine bed indicated at 25 and associated with 10. See for example clamp or clamps 200 adjusted to hold the support 22 to bed 25. The clamps are preferably removable to permit transport of the apparatus to another site.

The angled slide 27 is supported by mount 28*a* rigidly mounted on the support 22, the slide 27 being movable endwise (see arrows 33) relative to the structure 20 and at a predetermined angle a relative to the plane of the top surface 29 of the support 22.

A rotary grinder 31 is carried on the angled slide 27 to be movable endwise therewith in direction 33, while the grinder head 31*a* is rotated about an axis 32 parallel to the direction of sliding movement of the slide 27. See arrows 33. A motor to rotate the head 31*a* is indicated at 34; and 35 indicates the slidable connection of the grinder head to move endwise in the direction of axis 32.

The grinder head 31*a* is operated to engage the spindle bore 13 for grinding same to true the bore as the spindle rotates and as the head rotates, whereby the bore is concentrically trued about the spindle axis 12.

In accordance with a further aspect of the invention, the spindle 10 is adjusted to bring a master plate surface 29 into facing relation to the spindle axis 12, and to bring the center 29*a* of that surface into coincidence with axis 12, after which time the grinder may be operated, as described, to true the bore. The master plate 30 has a boundary being employed during the adjustment of spindle 10, as referred to. Typically, the boundary indicated at 38 extends circularly about the master plate surface, and about center 29*a*, whereby a sensor, including an indicator 39, may be employed to engage the circular boundary during the spindle position adjustment, as referred to. The indicator is carried by a shaft 40 associated with the spindle, that shaft having an axis coincident with axis 12. During set up, the shaft carrying the indicator is rotated about axis 12, and the indicator tip 39*a* engages the circular boundary, or edge 38, of the plate 30 and surface 29. Axis 12 remains perpendicular to machine bed surface 25*a*.

If the indicator displays no gauge movement as shaft 40 is rotated, it means that the adjustment of the spindle has been such as to locate edge 38 concentrically about axis 12, and to locate center 29*a* coincident with axis 12. Such adjustment includes X-Y direction adjustment of the spindle relative to support 22. Axis 12 extends in the Z direction of the X-Y-Z rectangular coordinate system.

Thereafter, the grinding tool may be operated, as described, to true the tapered bore 13. As referred to, the grinding tool 31 may be moved endwise in opposite directions 33, now correctly angled relative to axis 12 for correctly truing the tapered bore about axis 12, as the grinding head is moved endwise back and forth.

After completion of grinding, the apparatus is separated from the spindle, and the latter is then in condition for mounting a rotary tool machine or device engaging the bore 13, correctly and accurately centered.

Figure 3:
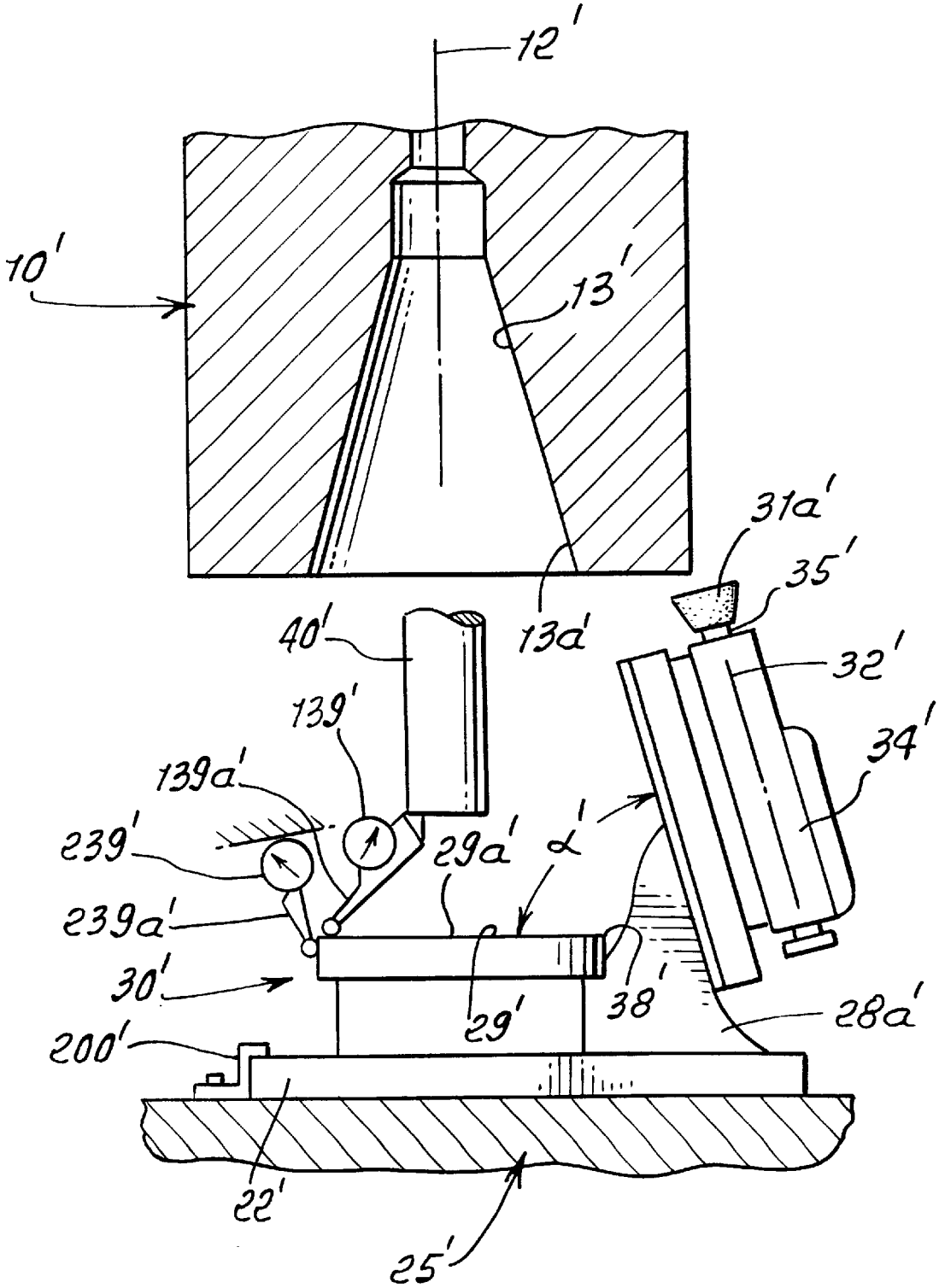
FIG. 3 is a schematic view of apparatus.
Figure 9:
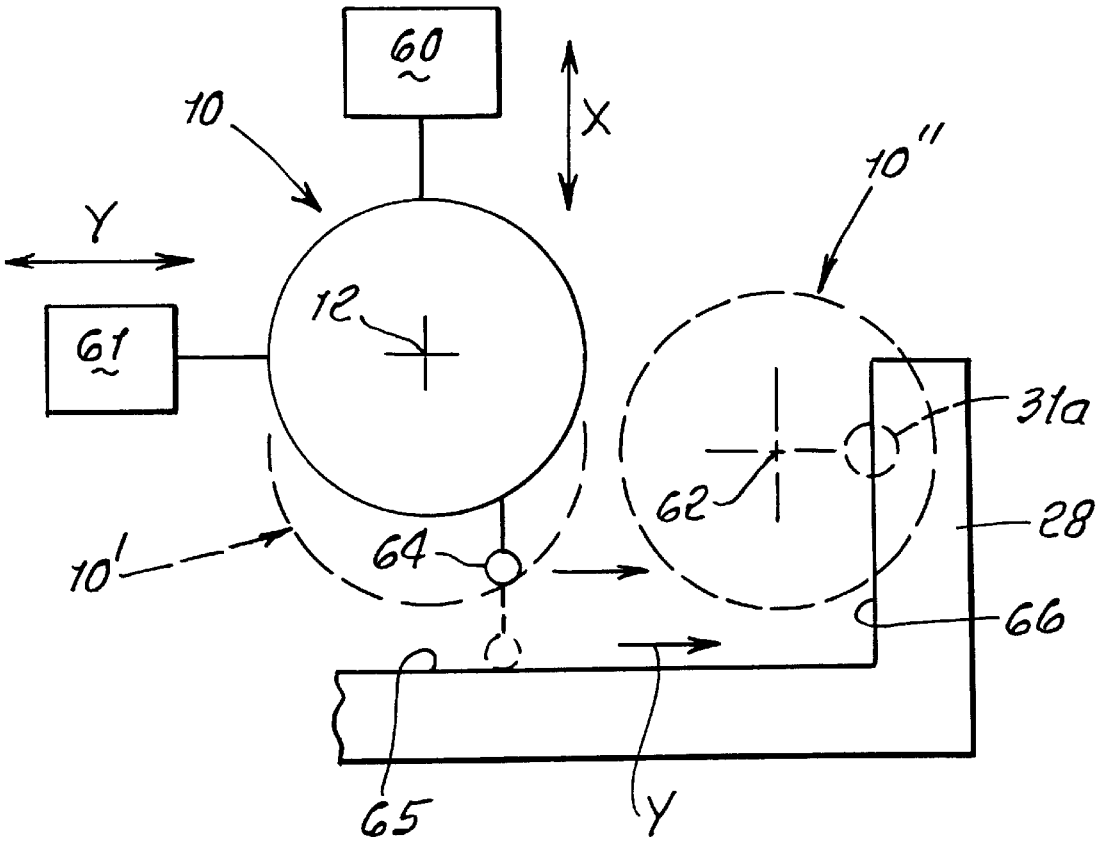

Referring to FIG. 3, the modified apparatus is generally like that of FIG. 2; and corresponding identifying numerals have an appended prime designation. Two indicators, 139' and 239', are employed on 40' and have tips 139*a*' engaging the top surface 29' near its outer edge, and engaging the outer cylindrical surface 130' of plate 30'. A machine bed is seen at 25', and a clamp or clamps at 200'.

Referring to the plan view of FIG. 4, spindle 10 having axis 12 is adjustable in X-Y directions as indicated, as by electrically or electronically numerically controllable drivers 60 and 61. Those drivers are operated to very accurately position the spindle axis 12 relative to the axis 62 of the cone defined by the angled slide 27, clamped to the machine bed, as described above. The position of the latter (and specifically cone axis 62) is therefore fixed relative to machine bed 25. For example spindle axis 12 is bodily displaced into coincidence with axis 62. See the broken line position 10" of the aligned spindle.

In this regard, the spindle is first displaced in the X-direction, i.e. to position 10', at which a gauge 64 carried by the spindle or its carrier body engages a guide surface 65, stopping further X-direction movement by drive 60. That surface 65 is carried by the support 22, clamped to the machine bed 25. Guide surface 65 extends in the Y-direction, as shown; and the spindle is then displaced by driver 61 in the Y-direction to position 10". The guide surface 65 is integral with mount 28 for the angled slide 27. Gauge 64 may also be used to engage a surface 66 carried by support 25 or mount 28, at which time axis 12 coincides with cone axis 62. Accordingly, advantage is taken of the accuracy of numerically controlled movement of the spindle, in X and Y directions, to achieve coincidence of axes 62 and 12, required for accurate grinding of the spindle taper.

To recapitulate the method of the invention includes the step of adjusting the spindle to bring the spindle bore into position to be ground by the grinder 31*a* as the grinder is moved on angled slide 27 relative to the bore, and as the spindle 10 rotates. This can be accomplished by providing a guide surface, as described, and integral with the support, adjusting of the spindle including moving the spindle in a first direction toward that guide surface, which extends in a second direction; and then moving the spindle lengthwise of the guide surface and in said second direction, to bring the spindle bore into position to the ground, by rotary grinder 31*a* on the angled slide 27.

Portability of the apparatus is enhanced by provision of a portable package that includes a minimum of elements (and therefore minimum weight), comprising the support 22, the angled slide 27, the rotary grinder 31, and the guide surface 65.

I claim:

1. An improved method of grinding the bore of a rotary spindle, said bore having a taper, to true said bore while the spindle rotates about a spindle axis, the steps that include:

a) providing a support attachable to a base associated with said spindle, b) providing an angled slide on said support, the slide being movable endwise relative to said spindle and at a predetermined angle to said axis, said angle corresponding to spindle bore taper, c) providing a rotary grinder on said angled slide to be movable endwise while the grinder rotates, d) bodily adjusting said spindle to bring said spindle bore into position to be ground by said grinder as the grinder is moved on said angled slide relative to the bore, and as the spindle rotates, e) operating said grinder to grind said tapered bore as the spindle is rotated and as said angled slide is moved endwise at said predetermined angle.

2. The method of claim 1 including attaching said support to said base to enable said adjusting of the spindle relative to the support and grinder.

3. The method of claim 2 including providing a motor drive for said rotary grinder to rotate same, and supporting said motor drive on said slide.

4. The method of claim 1 wherein said grinder includes a grinding head, and said operating of said grinder includes moving said head along an angle defined by said rotating tapered bore.

5. The method of claim 1 including providing a guide surface integral with the support, said adjusting of the spindle including bodily moving the spindle in a first direction toward said guide surface, which extend s a second direction; and bodily moving the spindle lengthwise of said guide surface and in said second direction, to bring the spindle bore into position to the ground.

6. The method of claim 5 wherein said guide surface is provided to extend in said second direction substantially at right angles to said first direction, and including removably attaching the support to said base.

7. The method of claim 1 which includes providing a package which includes said support, said angled slide, and said rotary grinder, and transporting said package to the location of said spindle and said base, for performing the steps a)–e) of claim 1.

8. The method of claim 5 which includes providing a package which includes said support, said slide, said rotary grinder and said guide surface, and transporting said package to the location of said spindle and said base, for performing the steps a)–e) of claim 1.

9. The method of claim 5 wherein said step of bringing the spindle bore into position to be ground comprises aligning the axis of the spindle with the axis of a cone defined by the angled slide.

10. Apparatus for grinding the bore of a rotary spindle, said bore having a taper, to true said bore while the spindle rotates, comprising a) a support attachable to a base associated with the spindle, b) an angled slide on the support, the slide being movable endwise relative to said spindle and at a predetermined angle to said axis, said angle corresponding to spindle bore taper, c) a rotary grinder on said angled slide to be movable endwise therewith while the grinder rotates, d) the spindle being bodily adjustable in two dimensions into a position enabling grinding of the spindle tapered bore by the grinder as the grinder is moved on said angled slide relative to said bore, and as the spindle rotates, e) said grinder then operable to grind said tapered bore as the spindle is rotated and as said angled slide is moved endwise at said predetermined angle, f) and including a guide surface integral with the support, said guide surface being free of attachment to the spindle, one of said two dimensions being a direction extending toward said guide surface, and the other of said two dimensions extending lengthwise of said guide surface, the spindle adjustment in said second direction guided by said guide surface whereby the spindle has successive locations along said second direction as it is moved toward said position.

11. The combination of claim 10 wherein the support, said angled slide and said rotary grinder define a portable package transportable to the site of the spindle.

12. The combination of claim 10 including a retainer removably retaining the support to said base, which is fixed.

* * * * *